United States Patent [19]

Bronstein-Bonte et al.

[11] Patent Number: 4,503,138

[45] Date of Patent: Mar. 5, 1985

[54] IMAGE-RECEIVING ELEMENT WITH UNITARY IMAGE-RECEIVING AND DECOLORIZING LAYER

[75] Inventors: Irena Y. Bronstein-Bonte, Newton; Edward P. Lindholm, Boston; Richard J. Murphy, Somerville, all of Mass.

[73] Assignee: Polaroid Corporation, Cambridge, Mass.

[21] Appl. No.: 528,557

[22] Filed: Sep. 1, 1983

[51] Int. Cl.[3] ..... G03C 5/54; G03C 1/40

[52] U.S. Cl. ..... 430/213; 430/216; 430/941

[58] Field of Search ..... 430/213, 215, 216, 941

[56] References Cited

U.S. PATENT DOCUMENTS

| | | | |
|---|---|---|---|
| 3,148,061 | 9/1964 | Haas | 430/213 |
| 3,208,964 | 9/1965 | Valle | 430/213 |
| 3,647,437 | 3/1972 | Land | 430/221 |
| 4,294,907 | 10/1981 | Bronstein-Bonte et al. | 430/213 |
| 4,298,674 | 11/1981 | Land et al. | 430/213 |
| 4,322,489 | 3/1982 | Land et al. | 430/213 |
| 4,340,522 | 7/1982 | Bronstein-Bonte et al. | 524/766 |
| 4,367,277 | 1/1983 | Chiklis et al. | 430/213 |

OTHER PUBLICATIONS

"Neutralizing Materials in Photographic Elements", *Research Disclosure*, No. 12331, 7/1974, pp. 22–24.

*Primary Examiner*—Richard L. Schilling
*Attorney, Agent, or Firm*—Louis G. Xiarhos

[57] ABSTRACT

Image-receiving elements for use in photographic diffusion transfer products and processes and including a unitary image-receiving and decolorizing layer are disclosed. The unitary image-receiving and decolorizing layer comprises a mixture of gelatin, an organic monobasic or polybasic acid or anhydride and a copolymeric mordant comprising recurring units from a vinylpyridine and from a copolymerizable vinylbenzyl quaternary ammonium salt. The image-receiving elements can be used in diffusion transfer products and processes for the provision of color images which appear satisfactorily to emerge from a white background and which exhibit desirable densitometric characteristics.

3 Claims, 1 Drawing Figure

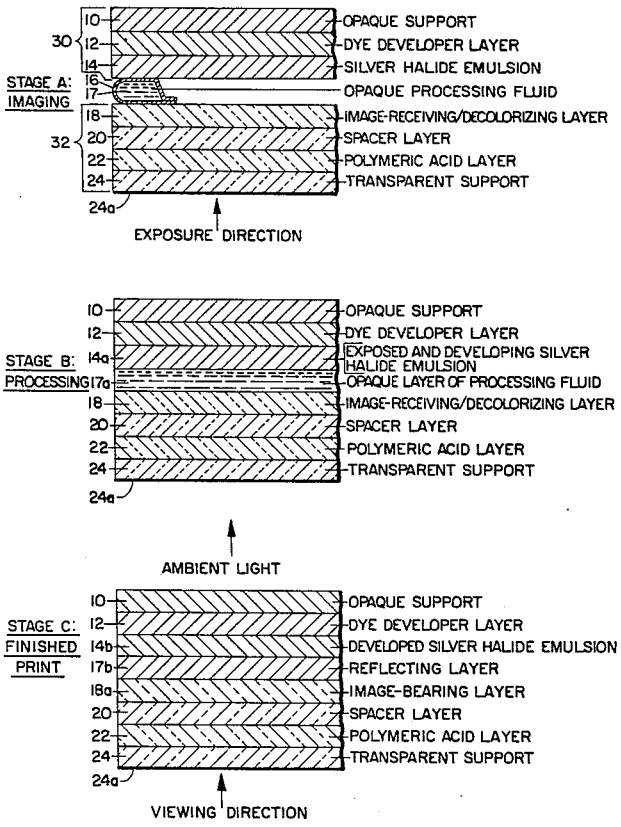

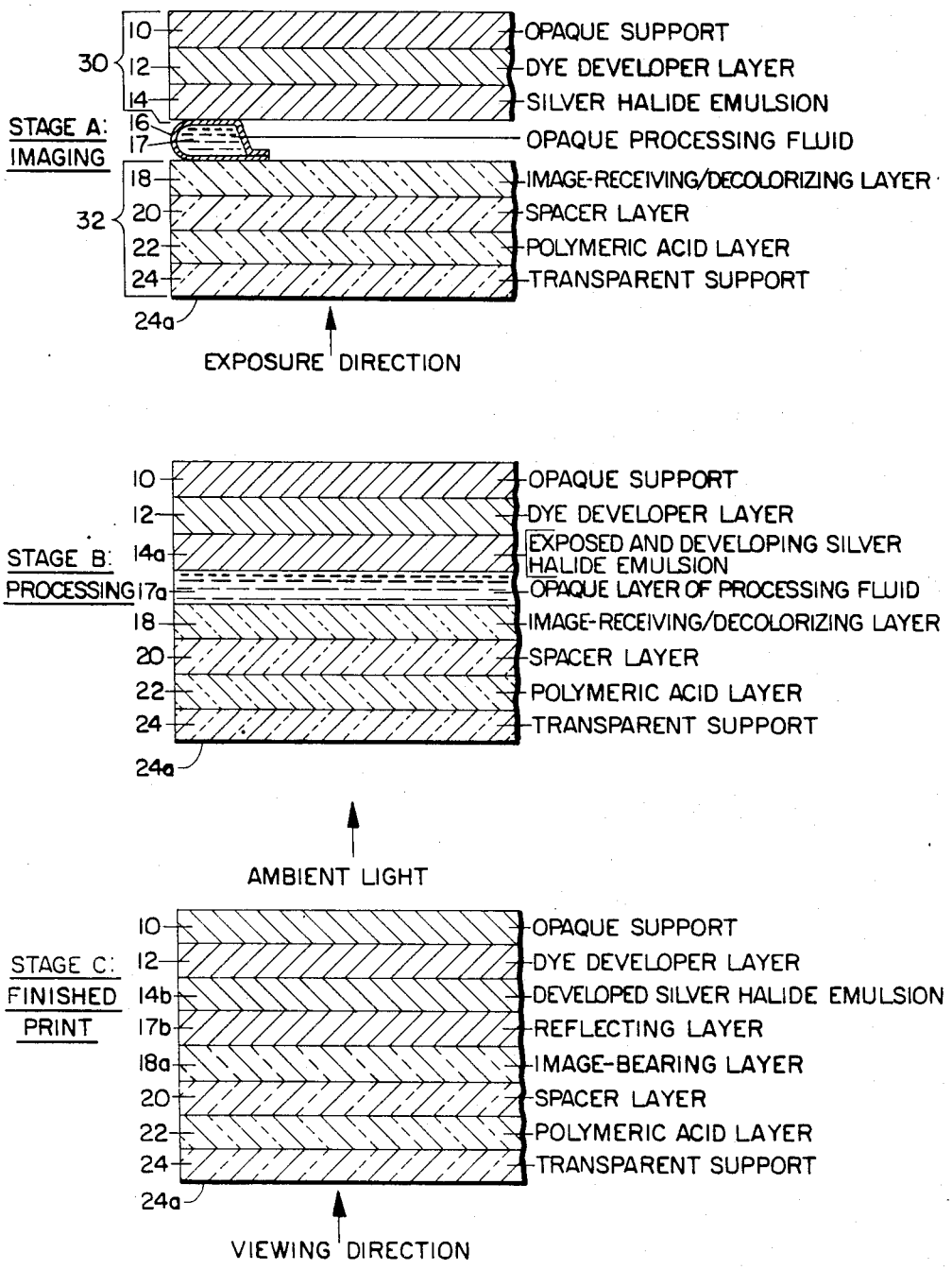
STAGE A: IMAGING
30
10
12
14
16
17
18
20
22
24
24a
32
OPAQUE SUPPORT
DYE DEVELOPER LAYER
SILVER HALIDE EMULSION
OPAQUE PROCESSING FLUID
IMAGE-RECEIVING/DECOLORIZING LAYER
SPACER LAYER
POLYMERIC ACID LAYER
TRANSPARENT SUPPORT
EXPOSURE DIRECTION
STAGE B: PROCESSING
10
12
14a
17a
18
20
22
24
24a
OPAQUE SUPPORT
DYE DEVELOPER LAYER
EXPOSED AND DEVELOPING SILVER HALIDE EMULSION
OPAQUE LAYER OF PROCESSING FLUID
IMAGE-RECEIVING/DECOLORIZING LAYER
SPACER LAYER
POLYMERIC ACID LAYER
TRANSPARENT SUPPORT
AMBIENT LIGHT
STAGE C: FINISHED PRINT
10
12
14b
17b
18a
20
22
24
24a
OPAQUE SUPPORT
DYE DEVELOPER LAYER
DEVELOPED SILVER HALIDE EMULSION
REFLECTING LAYER
IMAGE-BEARING LAYER
SPACER LAYER
POLYMERIC ACID LAYER
TRANSPARENT SUPPORT
VIEWING DIRECTION

IMAGE-RECEIVING ELEMENT WITH UNITARY IMAGE-RECEIVING AND DECOLORIZING LAYER

BACKGROUND OF THE INVENTION

This invention relates to image-receiving elements for photographic products and processes. More particularly, it relates to image-receiving elements especially suited to application in photographic diffusion transfer products and processes.

Diffusion transfer photographic products and processes have been described in numerous patents, including, for example, U.S. Pat. Nos. 2,983,606; 3,345,163; 3,415,644; 3,594,164; 3,594,165 and 3,647,437. The aforementioned U.S. Pat. No. 3,415,644 (issued Dec. 10, 1958 to Edwin H. Land) discloses photographic products and processes wherein a photosensitive element and an image-receiving element are maintained in fixed relationship prior to exposure, and wherein this relationship is maintained as a laminate after processing and image formation. In these products and processes, the final image is viewed through a transparent (support) element against a reflection, i.e., white, background. Photoexposure is made through said transparent element and application of the processing composition provides a layer of light-reflecting material to provide a white background for viewing the final image through said transparent support. The light-reflecting material (referred to in said patent as an "opacifying agent") is preferably titanium dioxide, and it also performs an opacifying function, i.e., it is effective to mask the developed silver halide emulsions so that the transfer image may be viewed without interference therefrom, and it also helps to protect the photoexposed silver halide emulsions from postexposure fogging by light passing through said transparent layer if the photoexposed film unit is removed from the camera before image-formation is completed.

In the aforementioned U.S. Pat. No. 3,647,437 (issued Mar. 7, 1972 to Edwin H. Land), there are disclosed photographic products which may be processed outside of the camera in which the film is exposed, fogging of the film by ambient light being prevented by provision of one or more opacifying dyes, sometimes referred to as light-absorbing optical filter agents, appropriately positioned in the film unit after photoexposure. According to a particularly useful embodiment of the invention there described, the film unit is a film unit of the type described in the aforementioned U.S. Pat. No. 3,415,644 and comprises first and second sheet-like elements, the first sheet-like element comprising an opaque base carrying a silver halide emulsion, and the second sheet-like element comprising a transparent support carrying an image layer, i.e., a layer adapted to receive an imagewise distribution of an image-forming material initially present in said first sheet-like element. After photoexposure a processing composition, adapted to develop the exposed silver halide emulsion and to form the desired image in said image layer, is distributed in a thin layer between said sheet-like elements. The processing composition contains a light-reflecting pigment, such as titanium dioxide, and at least one light-absorbing optical filter agent, such as a pH-sensitive phthalein dye which is colored at the initial pH of said processing composition. As is disclosed in the patent (aforementioned U.S. Pat. No. 3,647,437), the concentrations of light-reflecting pigment and optical filter agent(s) are such that the layer of processing composition is sufficiently opaque to light actinic to the silver halide emulsion that the film unit may be ejected from the camera immediately after the processing composition is distributed, notwithstanding the fact that the second sheet-like element will transmit light incident on the surface thereof. This opacification system is quite effective and is employed in Polaroid Land SX-70 film. The light-absorbing capacity of the optical filter agent is discharged after this ability is no longer needed, so that the optical filter agent need not be removed from the film unit. Where the optical filter agent is a pH-sensitive dye, such as a phthalein indicator dye, it may be discharged or decolorized by reducing the pH after a predetermined time, e.g., by making available an acid-reacting material such as a polymeric acid.

In the preferred embodiments of the opacification system described in U.S. Pat. No. 3,647,437 the concentrations of the light-reflecting pigment and light-absorbing optical filter agent in the layer of processing composition will be such that that layer will have a transmission density of at least about 6 but a reflection density not greater than about 1. The presence of a long chain substituent, e.g., a long chain alkoxy group, on the optical filter agent is useful in reducing its diffusibility so that diffusion to the image-receiving layer is minimized.

A reflection density of about 1 will be recognized as very small compared with a transmission density of 6 or more for the same layer. In practice it has been possible to use a concentration of optical filter agents and titanium dioxide such that the reflection density of the processing composition layer, as measured about 30 seconds after distribution, is much lower than 1, e.g., about 0.5 to 0.6. While transferring dye and the emerging dye image may be seen at opacification system reflection densities of about 0.5, the presence of such temporary coloration of the highlight or white areas of the image, and the temporary distortion of the colors of the already transferring image dyes, is aesthetically undesirable.

As noted above, where the optical filter agent is a pH-sensitive dye, it is "discharged", i.e., rendered substantially colorless, by a reduction of the pH of the strata containing the optical filter agent. These strata include the light-reflecting pigment layer, provided by the processing composition, as well as the image-receiving layer and any other layers between the light-reflecting pigment layer and the transparent support through which the final image is viewed. This pH reduction is effected, to a pH level below the pKa of the optical filter agent, after a predetermined time. This delay is necessary in order that silver halide development be substantially completed before incident light is transmitted to the developing silver halide emulsions. Since the image dyes are preferably soluble and diffusible at the initial pH of the process but substantially nondiffusible at a lower pH, reduction of the pH to the appropriate lower pH after a predetermined period serves the very important function of controlling unwanted continued transfer of image dyes after the desired dye image has been formed.

It will be recognized that these desired results of pH reduction are only partly compatible, for early pH reduction to provide a white background early in the process could prematurely stop transfer of image dyes, resulting in a pale, i.e., low density, image which may also have an unbalanced color balance.

In U.S. Pat. No. 4,294,907 (issued Oct. 13, 1981 to I. Y. Bronstein-Bonte et al.), and in U.S. Pat. No. 4,298,674 (issued Nov. 3, 1981 to Edwin H. Land et al.), there are disclosed photographic diffusion transfer products and processes of the foregoing type where the background appears substantially white to the viewer, substantially immediately after the processing composition is applied while retaining opacification. As is disclosed in these patents, the reflection density provided by the layer of processing composition (containing the light-reflecting pigment and the optical filter agent) can be reduced without significantly reducing the transmission density thereof. This highly desirable improvement is obtained by the provision of a polymeric "decolorizing" layer between the image-receiving layer and the layer of processing composition. The decolorizing layer comprises a relatively thin layer of a substantially non-diffusible polymeric agent adapted to decolorize the small concentration of optical filter agent present immediately adjacent the interface between the processing composition and the decolorizing layer. As a consequence of the decolorization of optical filter agent at this interface, image formation appears to emerge rapidly from a substantially "white" background.

While the utilization of a polymeric decolorizing agent in accordance with teachings and embodiments of the aforesaid patents permits one to effectively increase the apparent whiteness of the layer of the processing composition against which the image is viewed, without reducing the transmission density of the "white" layer to any significant extent, the provision of such decolorizing layer involves the handling and application of the polymeric decolorizing material as a separate layer over an image-receiving layer. Thus, a solvent system for the decolorizing polymer, selected to avoid incompatibility with the image-receiving layer or other layer of an image-receiving element, is utilized for the application of the decolorizing layer over a suitable image-receiving layer. The decolorizing layer, depending upon the particular nature thereof, may be more or less adherent to the particular image-receiving layer utilized.

SUMMARY OF THE INVENTION

According to the present invention, there is provided an image-receiving element adapted to utilization in a photographic diffusion transfer product or process and comprising a transparent support; and a unitary image-receiving and decolorizing layer comprising a mixture of gelatin, an organic monobasic or polybasic acid or anhydride, and a copolymeric mordant comprising recurring units according to the formula

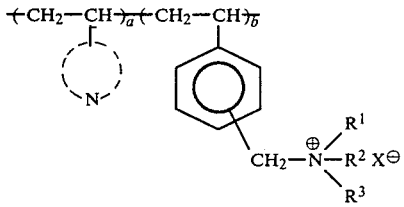

wherein the nitrogen-containing heterocyclic moiety represents a pyridyl ring, each of $R^1$, $R^2$ and $R^3$ is independently alkyl, substituted alkyl, cycloalkyl, aryl, aralkyl, alkaryl, or at least two of $R^1$, $R^2$ and $R^3$ together with the quaternary nitrogen atom to which they are bonded complete a saturated or unsaturated, substituted or unsubstituted nitrogen-containing heterocyclic ring, X is an anion, and wherein the molar ratio of the respective recurring units represented by integers a and b is in the range of from about 0.1:1 to about 10:1.

It has been found that an image-receiving element having a unitary image-receiving and decolorizing layer as aforedescribed can be utilized in diffusion transfer photographic products for the provision of color images which appear satisfactorily to emerge from a white background and which exhibit desirable densitometric characteristics.

BRIEF DESCRIPTION OF DRAWING

The FIGURE is a diagrammatic cross-sectional representation of the imaging and processing in the production of a finished photographic print according to one embodiment of the invention.

DETAILED DESCRIPTION OF THE INVENTION

As indicated above, this invention is primarily directed to image-receiving elements for photographic processes wherein the desired image is obtained by processing an exposed photosensitive silver halide material, with a processing composition distributed between two sheet-like elements, one of said elements including said photosensitive material. The processing composition is so applied and confined within and between the two sheet-like elements as not to contact or wet outer surfaces of the superposed elements, thus providing a film unit or film packet whose external surfaces are dry. The processing composition is viscous and preferably is distributed from a single-use rupturable container; such pressure rupturable processing containers are frequently referred to as "pods". The final image may be either negative or positive with respect to the photographed subject. The present invention is especially, it not uniquely, adapted for facilitating processing outside of a camera film units which are maintained as an integral laminate after processing, the desired image being viewed through one face of said laminate.

In diffusion transfer embodiments of this invention, the diffusible image-providing substance may be a complete dye or a dye intermediate, e.g., a color coupler. The preferred embodiments of this invention use a dye developer, that is, a compound which is both a silver halide developing agent and a dye disclosed in U.S. Pat. No. 2,983,606, issued May 9, 1961 to Howard G. Rogers. As is now well known, the dye developer is immobilized or precipitated in developed areas as a consequence of the development of the latent image. In unexposed and partially exposed areas of the emulsion, the dye developer is unreacted and diffusible and thus provides an imagewise distribution of unoxidized dye developer, diffusible in the processing composition, as a function of the point-to-point degree of exposure of the silver halide emulsion. At least part of this imagewise distribution of unoxidized dye developer is transferred, by imbibition, to the superposed image-receiving and decolorizing layer(as aforedescribed) to provide a reversed or positive color image of the developed image. The unitary image-receiving and decolorizing layer contains a copolymeric mordant as aforedescribed to mordant transferred unoxidized dye developer. The unitary image-receiving/decolorizing layer is not separated from its superposed contact with the photosensitive element, subsequent to transfer image formation, inasmuch as the support for the image-receiving layer, as well as any other layers intermediate said support and image-receiving layer, is transparent and a processing composition containing a substance, e.g., a white pigment, effective to mask the developed silver halide emulsion or emulsions is applied between the unitary image-receiving/decolorizing layer and said silver halide emulsion or emulsions.

Dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group.

Multicolor images may be obtained using the color image-forming components, for example, dye developers, in an integral multi-layer photosensitive element, such as is disclosed in the aforementioned U.S. patents. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion stratum, for example in the form of particles, or it may be disposed in a stratum (e.g., of gelatin) behind the appropriate silver halide emulsion stratum. Each set of silver halide emulsion and associated dye developer strata preferably are separated from other sets by suitable interlayers. In certain instances, it may be desirable to incorporate a yellow filter in front of the green-sensitive emulsion and such yellow filter may be incorporated in an interlayer. However, if the yellow dye developer has the appropriate spectral characteristics and is present in a state capable of functioning as a yellow filter, a separate yellow filter may be omitted.

For convenience, further description of this invention will be in the context of the use of dye developers and positive transfer images.

Referring to the Figure, Stages A, B and C show in diagrammatic cross-section, respectively, imaging, processing, and the finished print in one embodiment of this invention. For ease of understanding, the Figure illustrates the formation of a monochrome image using a single dye developer. In Stage A, there is shown a photosensitive element 30 in superposed relationship with an image-receiving element 32, with a rupturable container 16 (holding an opaque processing composition 17) so positioned as to discharge its contents between said elements upon suitable application of pressure, as by passing through a pair of pressure applying rolls or other pressure applying means (not shown). Photosensitive element 30 comprises an opaque support 10 carrying a layer 12 of a dye developer over which has been coated a silver halide emulsion layer 14.

The image-receiving element 32 comprises a transparent support 24 carrying, in turn, a polymeric acid layer 22, a spacer layer 20, and a unitary image-receiving/decolorizing layer 18 as aforedescribed. Photoexposure of the silver halide emulsion layer is effected through the transparent support 24 and the layers carried thereon, i.e., the polymeric acid layer 22, the spacer layer 20, and the unitary image-receiving-/decolorizing layer 18, which layers are also transparent, the film unit being so positioned within the camera that light admitted through the camera exposure or lens system is incident upon the outer or exposure surface **24*a* of the transparent support 24**.

After exposure, the film unit is advanced between suitable pressure-applying members, rupturing the container 16, thereby releasing and distributing a layer **17*a* of the opaque processing composition and thereby forming a laminate, as illustrated in processing Stage B, of the photosensitive element 30 and the image-receiving element 32 with their respective support members providing the outer layers of the laminate (illustrated in Stage B). The opaque processing composition contains a film-forming polymer, a white pigment and has an initial pH at which one or more optical filter agents contained therein are colored; the optical filter agent (agents) is (are) selected to exhibit the appropriate light absorption, i.e., optical density, over the wavelength range of light actinic to the particular silver halide emulsion(s). As a result, ambient or environmental light within that wavelength range incident upon transparent support surface 24*a* and transmitted transversely through said transparent support and the transparent layers carried thereon in the direction of the exposed silver halide emulsion 14*a* is absorbed thereby avoiding further exposure of the photoexposed and developing silver halide emulsion 14*a*. In exposed and developed areas, the dye developer is oxidized as a function of the silver halide development and immobilized. Unoxidized dye developer associated with undeveloped and partially developed areas remains mobile and is transferred imagewise to the unitary image-receiving/decolorizing layer 18** to provide the desired positive image therein.

Permeation of the alkaline processing composition through the image-receiving/decolorizing layer 18 and the spacer layer 20 to the polymeric acid layer 22 is so controlled that the process pH is maintained at a high enough level to effect the requisite development and image transfer and to retain the optical filter agent (agents) in colored form within the processing composition layer **17*a*, after which pH reduction effected as a result of alkali permeation into the polymeric acid layer 22** is effective to reduce the pH to a level which changes the optical filter agent to a colorless form.

Absorption of the water from the applied layer **17*a* of the processing composition results in a solidified film composed of the film-forming polymer and the white pigment dispersed therein, thus providing reflecting layer 17*b* which also serves to laminate together the photosensitive component 30 and the image-receiving component 32 to provide the final laminate (Stage C). The positive transfer image in dye developer present in the image-bearing layer 18*a* is viewed through the transparent support 24 and the intermediate transparent layers against the reflecting layer 17*b* which provides an essentially white background for the dye image and also effectively masks from view the developed silver halide emulsion 14*b* and dye developer immobilized therein or remaining in the dye developer layer 12**.

The optical filter agent is retained within the final film unit laminate and is preferably colorless in its final form, i.e., exhibiting no visible absorption to degrade the transfer image or the white background therefor provided by the reflecting layer **17*b*. The optical filter agent may be retained in the reflecting layer under these conditions, and it may contain a suitable "anchor" or "ballast" group to prevent its diffusion into adjacent layers. Some of the optical filter agent may diffuse into the photosensitive component and be mordanted by the gelatin or other material present on the silver halide emulsion side of the reflecting layer 17***b;* optical filter mordanted in the photosensitive component 30 may be colorless or colored in its final state so long as any color exhibited by it is effectively masked by the reflecting layer 17*b.* In a preferred embodiment, the photosensitive element contains gelatin, and the optical filter agent(s) is a pH-sensitive phthalein dye.

In the illustrated embodiment, photoexposure is effected through the image-receiving element. While this is a particularly useful and preferred embodiment, especially where the photosensitive element and the image-receiving element are secured together as shown in U.S. Pat. Nos. 3,415,644 and 3,647,437, it will be understood that the image-receiving element may be initially positioned out of the exposure path and superposed upon the photosensitive element after photoexposure.

A light-absorbing material optical filter agent, preferably a pH-sensitive dye such as an indicator dye, is provided so positioned and/or constituted as not to interfere with photoexposure but so positioned between the photoexposed silver halide emulsions and the transparent support during processing after photoexposure as to absorb light which otherwise might fog the photoexposed emulsions. Furthermore, the light-absorbing material is so positioned and/or constituted after processing as not to interfere with viewing the desired image shortly after said image has been formed. In the preferred embodiments, the optical filter agent is initially contained in the processing composition in colored form together with a light-reflecting material, e.g., titanium dioxide.

The concentration of indicator dye is selected to provide the optical transmission density required, in combination with other layers intermediate the silver halide emulsion layer(s) and the incident radiation, to prevent nonimagewise exposure, i.e., fogging, by incident actinic light during the performance of the particular photographic process. The transmission density and the indicator dye concentration necessary to provide the requisite protection from incident light may be readily determined for any photographic process by routine experimentation, as a function of film speed or sensitivity, processing time, anticipated incident light intensity, etc., as described in said U.S. Pat. No. 3,647,437. It will be recognized that a particular transmission density may not be required for all portions of the spectrum, lesser density being sufficient in wavelength regions corresponding to lesser sensitivities of the particular photosensitive material.

In a particularly useful embodiment, the light-absorbing dye is highly colored at the pH of the processing composition, e.g., 13–14, but is substantially not-absorbing of visible light at a lower pH, e.g., less than 10–12. Particularly suitable are phthalein dyes having a pKa of about 13 to 13.5; many such dyes are described in the aforementioned U.S. Pat. No. 3,647,437. This pH reduction may be effected by an acid-reacting reagent appropriately positioned in the film unit, e.g., in a layer between the transparent support and the image-receiving-/decolorizing layer, as described in more detail below.

It will be understood that a mixture of light-absorbing materials may be used so as to obtain absorption in all critical areas of the visible and near-visible by which the silver halide emulsions, e.g., a panchromatic black-and-white silver halide emulsion or a multicolor silver halide photosensitive element, being used are exposable. Many dyes which change from colored to colorless as a function of pH reduction, e.g., phthalein dyes, are known and appropriate selection may be made by one skilled in the art to meet the particular conditions of a given process and film unit; such dyes are frequently referred to in the chemical and related arts as indicator dyes.

In accordance with this invention the optical filter agent(s) is a pH-sensitive phthalein dye and decolorizing functionality is provided by the components or ingredients of the unitary image-receiving/decolorizing layer. These components are described in greater detail hereinafter.

Gelatin comprises an essential component of the unitary image-receiving/decolorizing layer. The gelatin component provides a suitable vehicle or matrix for the copolymeric mordant and monomeric acid components. The gelatin component permits a suitable image-receiving layer to be prepared by conventional coating technique and serves to provide a permeated medium for the mordant and acidic components wherein such components are distributed substantially uniformly throughout the gelatin medium and are available during processing for their respective purposes or functions. Any of a variety of gelatin materials known in the photographic arts can be used herein. In general, such gelatin materials will be compatible and, thus, not interfere with mordanting functionality. Preferably, the gelatin material will be an inert gelatin.

In addition to providing a medium for the mordant and acidic components of the unitary image-receiving-/decolorizing layer, the gelatin component is believed to contribute to desired decolorization although the mechanism for such decolorization is not entirely understood. The gelatin component is also believed to contribute to the realization of good photographic Dmin aging performance. In this connection, increases in Dmin upon storage are believed to be minimized in part by reason of the presence of the gelatin component of the unitary image-receiving/decolorizing layer.

The copolymeric mordant hereof constitutes an essential component of the unitary layer in providing important mordanting capability essential to image formation. In general, these copolymeric mordants contain recurring units according to the formula:

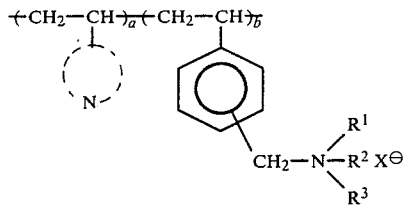

Formula (I)

wherein the nitrogen-containing heterocyclic moiety and each of $R^1$, $R^2$, $R^3$ and X has the meaning aforedescribed; and wherein each of a and b is an integer and the molar ratio of a:b is from about 0.1:1 to about 10:1.

As can be appreciated from inspection of Formula I, the copolymeric mordants of the present invention comprise recurring units resulting from the polymerization of copolymerizable ethylenically-unsaturated comonomers. Thus, the copolymers comprise repeating or recurring units resulting from the polymerization of a comonomeric vinylpyridine. In addition, the copolymers comprise repeating or recurring units from a copolymerizable vinylbenzyl quaternary ammonium salt having the formula

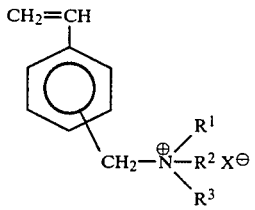

Formula (II)

wherein each of $R^1$, $R^2$, $R^3$ and X have the meanings hereinbefore ascribed.

The nature of the quaternary nitrogen groups of the compounds of Formula II and of the recurring units of the copolymeric mordants can vary with nature of the $R^1$, $R^2$ and $R^3$ groups thereof. Thus, the $R^1$, $R^2$ and $R^3$ substituents on the quaternary nitrogen atom of the compounds of Formula II, and present in the recurring units of the copolymeric mordants hereof, can each be alkyl (e.g., methyl, ethyl, propyl, butyl); substituted-alkyl (e.g., hydroxyethyl, hydroxypropyl); cycloalkyl (e.g., cyclohexyl); aryl (e.g., phenyl, naphthyl); aralkyl (e.g., benzyl); or alkaryl (e.g., tolyl). Preferred $R^1$, $R^2$ and $R^3$ groups include alkyl, such as alkyl groups of from 1 to about 8 carbon atoms, cyclohexyl and benzyl. Especially preferred compounds represented by Formula II and providing recurring units of the copolymeric mordants hereof are those wherein each of $R^1$, $R^2$ and $R^3$ is the same alkyl group such as methyl. Other preferred compounds herein are those, for example, wherein $R^1$ and $R^2$ are each alkyl, e.g., methyl, and $R^3$ is cyclohexyl.

As indicated previously, the groups $R^1$, $R^2$ and $R^3$ of the compounds of Formula II, and of the corresponding recurring units of the copolymeric mordants hereof, can complete with the quaternary nitrogen atom a nitrogen-containing heterocyclic ring. The nitrogen-containing heterocyclic ring can comprise a saturated or unsaturated ring and, additionally, can be a substituted or unsubstituted heterocyclic ring. It will be appreciated that the $R^1$, $R^2$ and $R^3$ groups can together comprise the atoms necessary to complete with the nitrogen atoms nitrogen-containing heterocyclic ring such as 1-pyridyl, morpholino or piperidino.

The particular nature of the $R^1$, $R^2$ and $R^3$ substituents of the compounds of Formula II and of the copolymeric mordants hereof will depend upon the particular mordanting capability desired in the copolymeric mordant and upon any influence of such substituent groups on such properties of the copolymeric mordants as solubility, swellability or coatability. The $R^1$, $R^2$, and $R^3$ groups of a recurring unit of the copolymeric mordants hereof can, as indicated, be the same or different to suit particular applications. Similarly, copolymeric mordants comprising recurring units from two or more compounds represented by the structure of Formula II are also contemplated herein. Such copolymeric mordants may comprise recurring units from each of differently substituted compounds exhibiting differences in mordanting capability or affinity to dyes or variously affecting desired properties of the copolymeric mordants. It will be appreciated that copolymeric mordants of this type can be prepared by the polymerization of 4-vinylpyridine, 2-methyl-5-vinylpyridine, or a mixture thereof, with a mixture of two or more dissimilar ethylenically-unsaturated copolymerizable compounds represented by the structure of Formula II, i.e., a mixture of compounds wherein the $R^1$, $R^2$ and $R^3$ substitution of the respective compounds is different.

The moiety X shown in the compounds represented by structure of Formula II, and in the copolymeric mordants represented by the structure of Formula I, is an anion such as halide (e.g., bromide or chloride). Other anionic moieties representative of anion X include sulfate, alkyl sulfate, alkanesulfonate, arylsulfonate (e.g., p-toluenesulfonate), acetate, phosphate, dialkyl phosphate or the like. A preferred anion is chloride.

Suitable examples of ethylenically-unsaturated monomers representative of compounds of Formula II useful in the preparation of copolymeric mordants of the present invention are vinylbenzyl trimethyl ammonium chloride, vinylbenzyl trihexyl ammonium chloride, vinylbenzyl dimethylcyclohexyl ammonium chloride, vinylbenzyl dimethylbenzyl ammonium chloride, vinylbenzyl triethyl ammonium chloride, vinylbenzyl triethyl ammonium chloride and vinylbenzyl pyridinium chloride. Mixtures comprising positional isomers can be employed. A preferred vinylbenzyl quarternary salt comprises a mixture of positional isomers (para and meta) of vinylbenzyl trimethyl ammonium chloride.

The vinylpyridine comonomer utilized for the preparation of the copolymeric mordants hereof includes any of the pyridines having a vinylic substituent, thus, 2-vinylpyridine, 3-vinylpyridine and 4-vinylpyridine can be utilized. Alkyl-substituted vinylpyridines can also be utilized, e.g., 2-methyl-5-vinylpyridine. A mixture of vinylpyridine compounds can also be utilized.

The ratio of recurring units in the copolymeric mordants hereof, represented by integers a and b in the polymers of Formula I, can vary widely. The molar ratio of recurring units from the vinylpyridine to recurring units from the vinylbenzyl quaternary ammonium salt, i.e., the ratio of a:b, will normally vary within the range of from about 0.1:1 to about 10:1. The presence in the copolymeric mordants of proportions of recurring units from the vinylpyridine and from the vinylbenzyl quaternary ammonium salt such that the respective ratio of such recurring units is at least about 0.1 to 1 assures the introduction of hydrophobicity into the copolymeric mordant material. In general, higher densities are realizable where the content of recurring units from the vinylbenzyl quaternary ammonium salt is high relative to the proportion of the recurring units from the vinylpyridine. Correspondingly, a ratio greater than about 10:1 tends to introduce excess hydrophobicity into the polymeric material and reduce obtainable dye densities. It will be appreciated that within the aforesaid ranges, changes in the ratio of recurring units from the vinylpyridine and from the vinylbenzyl quaternary ammonium salt will influence the physical and functional properties of the copolymeric mordant materials of the invention.

Preferably, the relative proportions of recurring units from the vinylpyridine and from the vinylbenzyl quaternary ammonium salt will be such that the molar ratio of such respective recurring units is from about 0.3:1 to about 5:1. In general, such ratios will be preferred from the standpoint of the provision of copolymeric mordants of desired hydrophobic, solubility and coatability properties. Additionally, such copolymers permit the realization of efficient mordanting and desired maximum densities. An especially preferred mordant copolymer hereof comprises the following wherein the recurring units from the vinylbenzyl quaternary salt comprise a mixture of para and meta isomers and wherein the ratio of a:b is from about 2:1 to about 4:1 (e.g., 3:1).

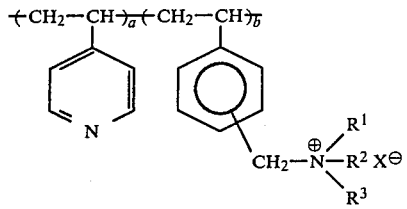

The copolymeric mordants utilized in the unitary image-receiving/decolorizing layer are known polymers and such polymers and methods for their preparation are described in detail in U.S. Pat. No. 4,322,489 (issued Mar. 30, 1982 to E. H. Land et al.) and in U.S. Pat. No. 4,340,522 (issued July 20, 1982 to I. Y. Bronstein-Bonte et al.).

The amount of copolymeric mordant utilized in the unitary image-receiving/decolorizing layer can vary with the particular photographic system employed. In general, the copolymeric mordant will be employed in an amount, in relation to the amount by weight of the gelatin, in the range of about 1:5 to about 5:1. A ratio less than about 1:5 may provide insufficient mordanting capacity for the unitary layer while a ratio greater than about 5:1 may result in inadequate image formation as a result of insufficient gelatin material for permeation of the layer. Good results are obtained, for example, where the ratio is in the range 1:2 to 2:1, a preferred ratio being about 0.6:1 to about 1:1.

The acidic component utilized in the unitary image-receiving/decolorizing layer comprises a monobasic or polybasic carboxylic acid compound or an anhydride thereof. Suitable acidic compounds include the aliphatic carboxylic acid compounds having one or more carboxylic acid groups (or corresponding precursor anhydride groups). Suitable examples are such monomeric acids as lactic acid, citric acid, succinic acid, malonic acid, adipic acid, ethylenediamine tetraacetic acid (EDTA) and N-hydroxyethyl-N,N',N'-triscarboxymethyl ethylene diamine.

The acidic component provides certain important functions in the unitary image-receiving/decolorizing layer. Thus, the acidic component provides decolorization at the interface of the unitary layer and the photographic processing composition layer such that the image appears to emerge from a substantially white background within about 7 to 10 seconds after the spreading of the photographic processing composition. In addition, the acid component provides a solubilizing function in promoting the solubility of the copolymeric mordant component which, owing to its vinylpyridine content, tends to exhibit limited solubility. The acidic monomer provides improved solubility for enhancement of mordanting capability.

The amount of monomeric acidic component utilized in the unitary image-receiving/decolorizing layer can vary consistent with the attainment of efficient decolorization and good photographic performance. Thus, the amount of acidic component should be sufficient to promote solubilization of the copolymeric mordant and to provide satisfactory "clearing", i.e., decolorization at the interface of the unitary layer and the processing composition within an acceptable and predetermined time frame, such that image formation is perceived within such time frame to emerge from a substantially white background. Similarly, the acid component should not present in such excessive amount as to prematurely stop the transfer of image dyes, resulting in a pale, i.e., low density, image. In general, the amount by weight of the acid component, in relation to the copolymeric mordant, will be in the range of about 0.1:1 to 1:1. Good results are obtained, for example, where the acid and copolymeric mordant are utilized at a ratio, respectively, of about 0.4:1 to about 0.8:1.

While the precise mechanism by which the components of the unitary layer function to provide decolorization is not entirely understood, a pH change involving the acidic component and pH-sensitive dye at the interface of the unitary layer and the processing composition layer containing the pH-sensitive dye is believed in part to be involved. The component does not, however, prevent premature cessation of image-forming dyes by premature reduction of the environmental pH with a photographic film unit. The unitary layer provides effective decolorization of pH-sensitive phthalein dyes used in the processing of such film units; these dyes contain the grouping

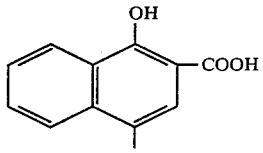

and are known pH-sensitive dyes for use in the opacification of photographic film units.

The unitary layer hereof, in addition to the components described hereinbefore, can contain other agents or adjuvants which provide other desired properties or functionality. For example, the unilayer can contain a UV stabilizer for image stability, a hardener for the layer or other desired agent. A preferred unilayer will contain a hardening agent such as 1,4-butanediol diglycidyl ether.

A preferred image-receiving element for use in diffusion transfer film units comprises a transparent polyethylene terephthalate support carrying a unitary image-receiving/decolorizing layer of gelatin and a copolymeric mordant having the following recurring units

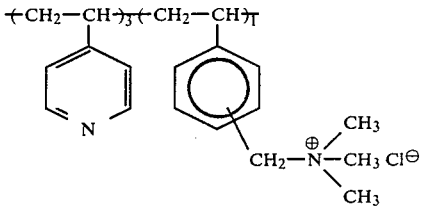

in a weight ratio of copolymeric mordant to gelatin of from about 0.6:1 to about 1:1; lactic or succinic decolorizing acid (or a mixture thereof) in a ratio to said copolymeric mordant of from about 0.4:1 to about 0.8:1, and, optionally, an amount of gelatin hardener (such as 1,4-butanediol diglycidyl ether) up to about 4% by wt. of the unilayer, e.g., up to about 2%.

The image-receiving/decolorizing layer can be conveniently applied as a single layer to a suitable transparent support to provide a image-receiving element which exhibits certain desirable photographic performance attributes in diffusion transfer processing. Thus, upon application of a layer of processing composition between the image-receiving element and a photoexposed negative element for the processing thereof, the emergence of a discernible image is observed to occur rapidly. This is believed attributable to rapid transfer of image dyes through the processing composition layer and into the unitary layer for the mordanting thereof. In addition, the background for the emerging image is perceived to clear or turn substantially white within a satisfactory time frame. Upon completion of development, there is provided a photographic image which upon storage is desirably free of objectional post-processing dye transfer manifested by stain formation, particularly in minimum-density areas.

While the aforesaid performance attributes can be realized by employment of an image-receiving element having a unitary image-receiving/decolorizing layer as aforedescribed, an additional layer (or layers) of material can be applied over the unitary layer where application of such other layer or layers is not objectionable from a manufacturing standpoint. Thus, for example, a layer of antistatic material can be applied over the unitary layer, if desired. Similarly, one or more layers of polymeric material can be applied over the unitary layer, for example, to augment clearing capacity or the more rapid appearance of a white background. Polymers suited for this purpose include those described in U.S. Pat. No. 4,294,907 (issued Oct. 13, 1981 to I. Y. Bronstein-Bonte) and U.S. Pat. No. 4,298,674 (issued Nov. 3, 1981 to E. H. Land et al.). These materials should not, however, be used in such amounts as to undesirably reduce image dye transfer or otherwise negate or adversely affect the advantageous properties realized by utilization of an image-receiving element embodying the unitary image-receiving/decolorizing layer of this invention.

The following Examples illustrate image-receiving elements of the present invention and photographic film units containing such elements. These Examples are merely illustrative and are not intended to be limitative.

EXAMPLE 1

An image-receiving element was prepared and utilized in the following manner for the production of a photographic image.

The image-receiving element comprised a transparent subcoated polyethylene terephthalate support coated with an image-receiving layer comprising about 2583 mgs./m.$^2$ of gelatin, about 1722 mgs./m.$^2$ of 3/1 copolymer of 4-vinylpyridine and vinylbenzyl trimethyl ammonium chloride, about 861 mgs./m.$^2$ of succinic acid and about 72 mgs./m.$^2$ of 1,4-butanediol diglycidyl ether.

As a negative element, there was utilized a negative comprising an opaque subcoated polyethylene terephthalate film base on which the following layers were coated in succession:

1. as a polymeric acid layer approximately nine parts of a half butyl ester of polyethylene/maleic anhydride copolymer and one part of polyvinyl butyral coated at a coverage of about 26,460 mgs./m.$^2$;
2. a timing layer comprising a mixture of about 3500 mgs./m.$^2$ of a 60/29/6/4/0.4 pentapolymer of butylacrylate, diacetone acrylamide, methacrylic acid, styrene and acrylic acid and about 211 mgs./m.$^2$ of gelatin;
3. a cyan dye developer layer comprising about 672 mgs./m.$^2$ of a cyan dye developer represented by the formula

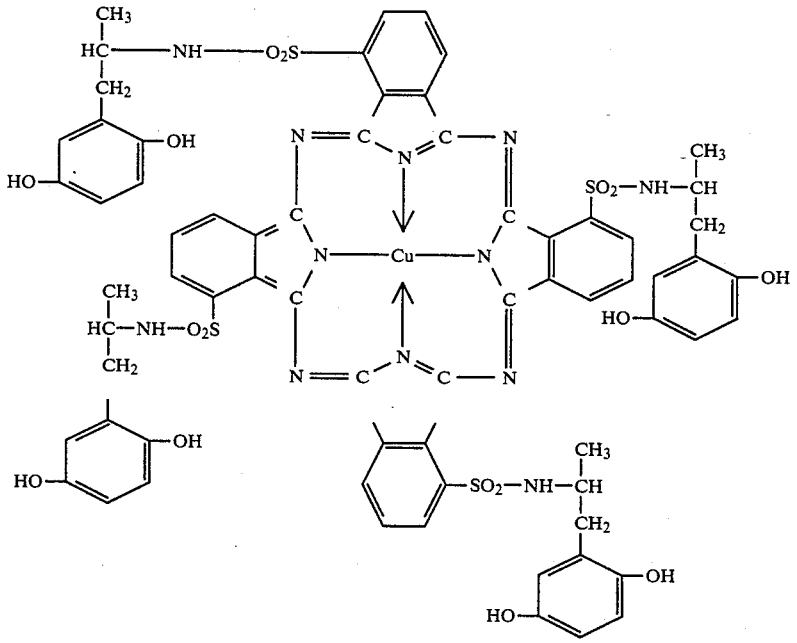

about 136 mgs./m.$^2$ of 4'-methylphenylhydroquinone and about 336 mgs./m.$^2$ of gelatin;

4. a layer comprising a mixture of about 950 mgs./m.$^2$ of titania, about 357 mgs./m.$^2$ of polymethylmethacrylate latex having an average particle size of about 0.11, about 357 mgs./m.$^2$ of the pentapolymer described in layer 2 and about 119 mgs./m.$^2$ of gelatin;

5. a red-sensitive silver iodobromide emulsion layer comprising about 1300 mgs./m.$^2$ of silver and about 780 mgs./m.$^2$ of gelatin;
6. an interlayer comprising about 3000 mgs./m.$^2$ of the pentapolymer described in layer 2, about 30 mgs./m.$^2$ of polyacrylamide and about 30 mgs./m.$^2$ of succindialdehyde;
7. a magenta dye developer layer comprising about 600 mgs./m.$^2$ of a magenta dye developer represented by the formula

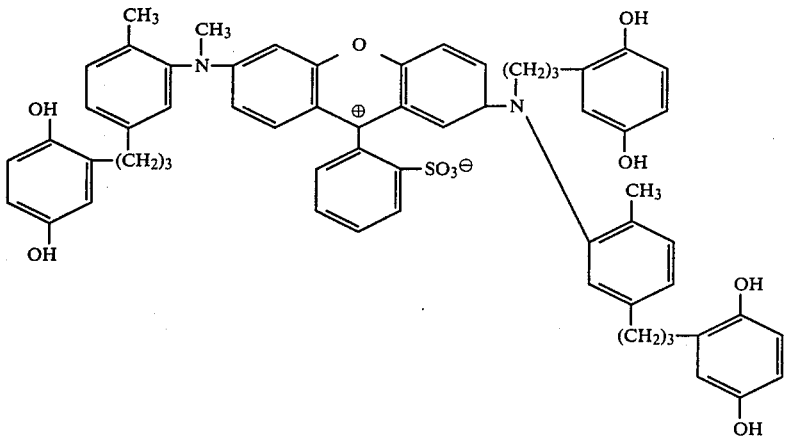

and about 300 mgs./m.$^2$ of gelatin;
8. a green-sensitive silver iodobromide emulsion layer comprising about 1330 mgs./m.$^2$ of silver and about 623 mgs./m.$^2$ of gelatin;
9. an interlayer comprising about 2500 mgs./m.$^2$ of the pentapolymer described in layer 2, about 25 mgs./m.$^2$ of polyacrylamide, about 30 mgs./m.$^2$ of succindialdehyde and about 4 mgs./m.$^2$ of formaldehyde;
10. a layer comprising about 100 mgs./m.$^2$ of gelatin and about 150 mgs./m.$^2$ of phenylbenzimidazole;
11. a yellow dye developer layer comprising about 800 mgs./m.$^2$ of a yellow dye developer represented by the formula

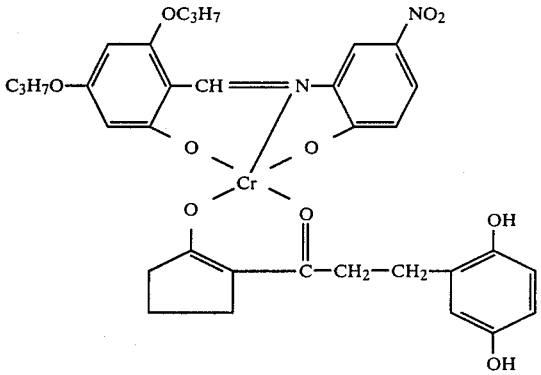

and about 320 mgs./m.$^2$ of gelatin;
12. a layer of gelatin coated at a coverage of about 125 mgs./m.$^2$;
13. a blue-sensitive silver iodobromide emulsion layer comprising about 950 mgs./m.$^2$ of silver, about 585 mgs./m.$^2$ of gelatin and about 250 mgs./m.$^2$ of 4'-methyl phenyl hydroquinone; and
14. a topcoat layer of about 484 mgs./m.$^2$ of gelatin.

A photographic film unit was prepared from the aforedescribed image-receiving and negative elements and was processed in the following manner. The negative element was photoexposed (two meter-candle-seconds) through a standardized wedge target. The photoexposed element was placed in a superposed relation with the image-receiving element and a rupturable container (retaining an aqueous alkaline processing composition) was fixedly mounted at the leading edge of each of the elements, by pressure-sensitive tapes to make a film unit, so that, upon application of compressive force to the container to rupture the marginal seal of the container, the contents thereof would be distributed between the elements placed in a face-to-face relationship, i.e., with their respective supports outermost.

The aqueous alkaline processing composition comprised the following components in the stated amounts.

| Components | Parts By Weight |
|---|---|
| Titanium dioxide | 48.1 |
| Potassium hydroxide | 4.67 |
| Poly(diacetone acrylamide)oxime | 0.67 |
| Benzotriazole | 0.46 |
| 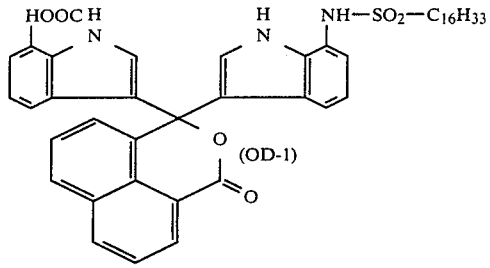 (OD-1) | 0.44 |
| 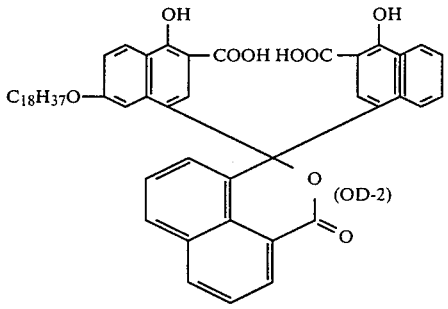 (OD-2) | 1.60 |

-continued

| Components | Parts By Weight |
|---|---|
| Citric acid | 0.31 |
| N—hydroxyethyl-N,N',N'—triscarboxymethyl ethylene diamine | 1.25 |
| 6-bromo-5-methyl-4-azabenzimidazole | 0.10 |
| Colloidal silica (30% solids) | 0.54 |
| Polyethylene glycol (M.W., approx. 4000) | 0.37 |
| N—phenethyl-α-picolinium bromide | 1.27 |
| N—phenethyl-pyridinium bromide | 0.21 |
| 1-(4-hydroxyphenyl)-tetrazoline-5-thione | 0.04 |
| 1-methylimidazole | 0.69 |
| 6-hydroxy-4-amino-pyrazolo-(3,4d)pyrimidine | 0.25 |
| Nickel acetate | 0.41 |
| Water | 38.6 |

The processing composition was distributed between the elements of the film unit by passing the film unit between a pair of pressure-applying rolls having a gap of approximately 0.0030 inch (0.076 mm.). The resulting laminate was maintained intact to provide a multicolor integral negative-positive reflection print.

As a control, a film unit was prepared and processed in the manner aforedescribed, except that the image-receiving element was comprised of a transparent subcoated polyethylene terephthalate support sheet carrying, in order, an image-receiving layer coated at a coverage of about 3330 mgs./m.$^2$ of a graft copolymer comprising 4-vinylpyridine (4VP) and vinylbenzyl trimethyl ammonium chloride (TMQ) grafted onto hydroxyethyl cellulose (HEC) at a ratio of HEC/4VP/TMQ of 2.2/2.2/1; and a topcoat layer comprising about 1076 mgs./m.$^2$ of unhardened gelatin.

The multicolor reflection prints obtained in the manner aforedescribed were evaluated by measuring minimum reflection densities in the red, green and blue columns. Measurements were taken initially and after storage under ambient room-temperature conditions for 30 days. The results are reported as follows in TABLE I.

| | Dmin | | | | | |
|---|---|---|---|---|---|---|
| | Initial | | | 30 Days | | |
| Film Unit | R | G | B | R | G | B |
| EXAMPLE 1 | 0.17 | 0.16 | 0.16 | 0.19 | 0.17 | 0.20 |
| Control | 0.18 | 0.17 | 0.18 | 0.22 | 0.20 | 0.25 |

As can be appreciated from inspection of the results reported in TABLE I, the photographic image provided from the film unit of EXAMPLE 1, relative to that of Control-I, showed a lesser tendency upon storage to increase in Dmin values, especially notable as yellowing, measured in the blue column.

EXAMPLE 2

A photographic film unit was prepared and processed in the manner described in EXAMPLE 1. The image-receiving element comprised a transparent subcoated polyethylene terephthalate support coated with an image-receiving layer comprising about 2583 mgs./m.$^2$ of gelatin, about 1722 mgs./m.$^2$ of 3/1 copolymer of 4-vinylpyridine and vinylbenzyl trimethyl ammonium chloride, about 817 mgs./m.$^2$ of succinic acid and about 72 mgs./m.$^2$ of 1,4-butanediol diglycidyl ether.

The negative element was an element as described in EXAMPLE 1. The photographic processing composition utilized for processing according to the procedure described in EXAMPLE 1 was a processing composition comprising the following components in the stated amounts.

| Components | Parts By Weight |
|---|---|
| Titanium dioxide | 47.4 |
| Potassium hydroxide | 4.73 |
| Poly(diacetone acrylamide)oxime | 0.66 |
| Benzotriazole | 0.45 |

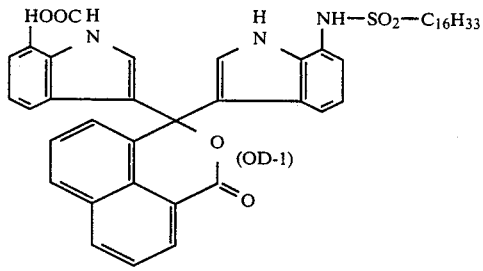

(OD-1) 0.44

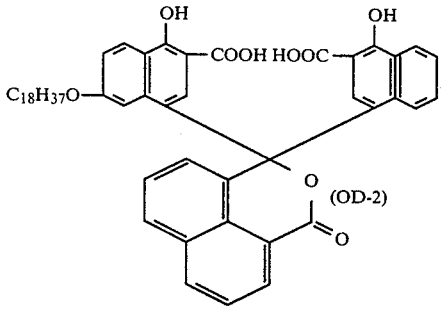

(OD-2) 1.60

| | |
|---|---|
| Citric acid | 0.30 |
| N—hydroxyethyl-N,N',N'—triscarboxymethyl ethylene diamine | 0.62 |
| 6-bromo-5-methyl-4-azabenzimidazole | 0.10 |
| Colloidal silica (30% solids) | 0.53 |
| Polyethylene glycol (M.W., approx. 4000) | 0.37 |
| N—phenethyl-α-picolinium bromide | 1.25 |
| N—phenethyl-pyridinium bromide | 0.20 |
| 1-(4-hydroxyphenyl)-tetrazoline-5-thione | 0.04 |
| 1-methylimidazole | 0.68 |
| 6-hydroxy-4-amino-pyrazolo-(3,4d)pyrimidine | 0.25 |
| Nickel acetate | 0.41 |
| Water | 40.0 |

Results of evaluation in the manner described in EXAMPLE 1 are reported as follows in Table II.

TABLE II

| | Dmin | | | | | |
|---|---|---|---|---|---|---|
| | Initial | | | 30 Days | | |
| Film Unit | R | G | B | R | G | B |
| EXAMPLE 2 | 0.19 | 0.17 | 0.16 | 0.22 | 0.20 | 0.21 |

EXAMPLE 3

A photographic film unit was prepared and processed in the manner described in EXAMPLE 1. The image-receiving element was an element comprised of a transparent subcoated polyethylene terephthalate support coated with an image-receiving layer comprising about 2583 mgs./m.$^2$ of gelatin, about 1722 mgs./m.$^2$ of a 3/1 copolymer of 4-vinylpyridine and vinylbenzyl trimethyl ammonium chloride about 1098 mgs./m.$^2$ of lactic acid and about 72 mgs./m.$^2$ of 1,4-butanediol diglycidyl ether.

The negative element was comprised of an opaque subcoated polyethylene terephthalate film base on which the following layers were coated in succession.

1. as a polymeric acid layer approximately nine parts of a half butyl ester of polyethylene/maleic anhydride copolymer and one part of polyvinyl butyral coated at a coverage of about 26,460 mgs./m.$^2$;
2. a timing layer comprising a mixture of about 2709 mgs./m.$^2$ of a 60-29-6-4-0.4 pentapolymer of butylacrylate, diacetone acrylamide, methacrylic acid, styrene and acrylic acid and about 41 mgs./m.2 of gelatin;
3. a cyan dye developer layer comprising about 511 mgs./m.$^2$ of a cyan dye developer represented by the formula

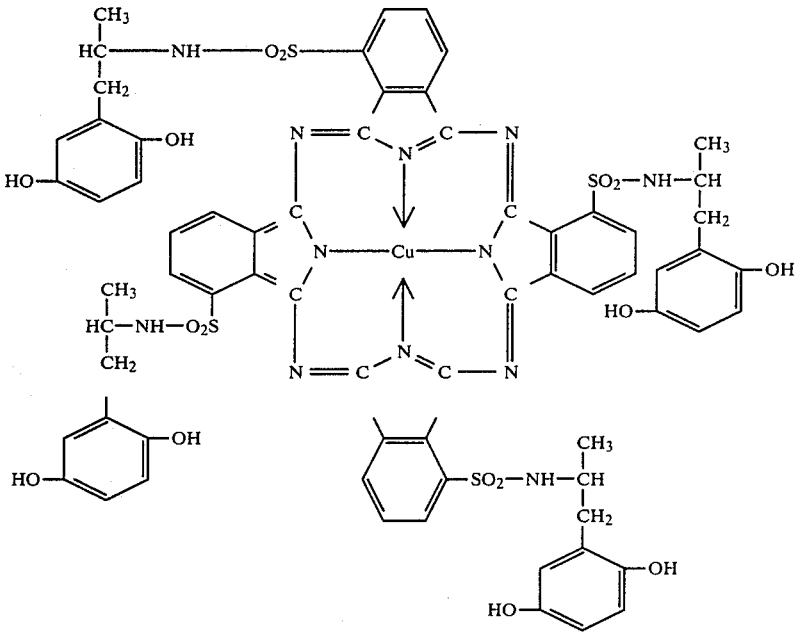

about 70 mgs./m.$^2$ of 4'methyl phenyl hydroquinone and about 256 mgs./m.$^2$ of gelatin;
4. a red-sensitive silver iodobromide emulsion layer comprising about 1378 mgs./m.$^2$ of silver and about 827 mgs./m.$^2$ of gelatin;
5. an interlayer comprising about 2090 mgs./m.$^2$ of the pentapolymer described in layer 2, about 110 mgs./m.$^2$ of polyacrylamide and about 44 mgs./m.$^2$ of succinaldehyde;
6. a magenta dye developer layer comprising about 427 mgs./m.$^2$ of a magenta dye developer represented by the formula

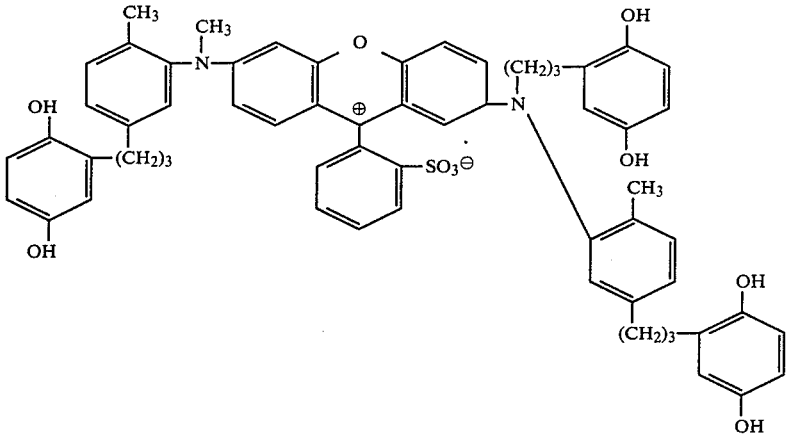

about 162 mgs./m.$^2$ phenylbenzimidazole and about 214 mgs./m.$^2$ of gelatin;
7. a green-sensitive silver iodobromide emulsion layer comprising about 706 mgs./m.$^2$ of silver and about 311 mgs./m.$^2$ of gelatin;
8. an interlayer comprising about 1881 mgs./m.$^2$ of the pentapolymer described in layer 2 and about 99 mgs./m.$^2$ of polacrylamide;
9. a layer comprising about 200 mgs./m.$^2$ of phenylbenzimidazole and about 167 mgs./m.$^2$ of gelatin;
10. a yellow dye developer layer comprising about 689 mgs./m.$^2$ of a yellow dye developer represented by the formula

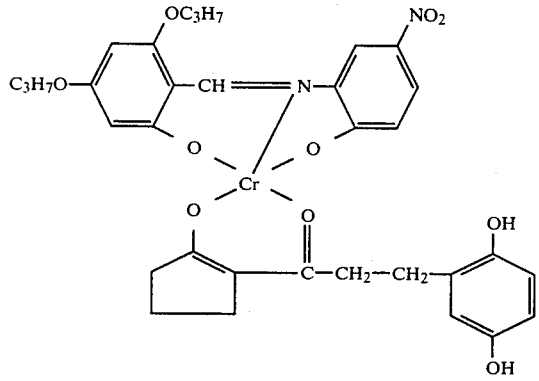

and about 276 mgs./m.$^2$ of gelatin;

11. a blue-sensitive silver iodobromide emulsion layer comprising about 764 mgs./m.$^2$ of silver, about 382 mgs./m.$^2$ of gelatin, and about 265 mgs./m.$^2$ of 4'-methyl phenyl hydroquinone; and
12. a topcoat layer of about 400 mgs./m.$^2$ of gelatin.

A film unit was assembled and processed according to the procedure described in EXAMPLE 1, except that the photoexposure was two meter-candle-seconds and the processing composition utilized was an alkaline processing composition comprising the following components with the stated amounts.

| Components | Parts By Weight |
|---|---|
| Titanium dioxide | 47.7 |
| Potassium hydroxide | 4.35 |
| Poly(diacetone acrylamide)oxime | 0.66 |
| Benzotriazole | 0.45 |
| 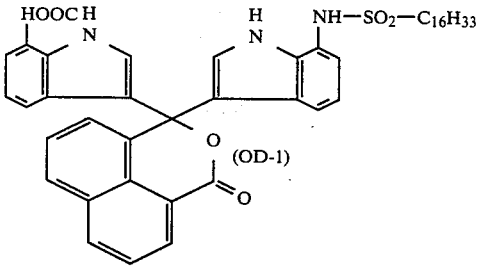 | 0.29 |
| 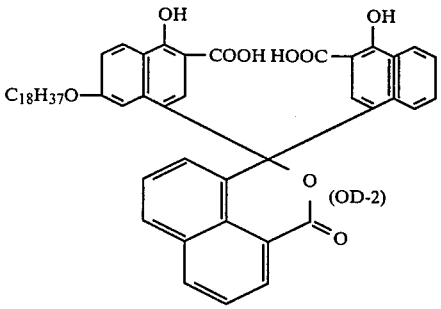 | 1.38 |
| 6-methyluracil | 0.25 |
| N—hydroxyethyl-N,N',N'—triscarboxymethyl ethylene diamine | 0.62 |
| 6-bromo-5-methyl-4-azabenzimidazole | 0.10 |
| Colloidal silica (30% solids) | 0.53 |
| Polyethylene glycol (M.W., approx. 4000) | 0.37 |
| N—phenethyl-α-picolinium bromide | 1.05 |
| Hypoxanthene | 0.10 |
| 1-(4-hydroxyphenyl)-tetrazoline-5-thione | 0.04 |

-continued

| Components | Parts By Weight |
|---|---|
| 1-methylimidazole | 0.69 |
| 2-methylimidazole | 0.40 |
| 3,5-dimethylpyrazole | 0.16 |
| Nickel acetate | 0.41 |
| Water | 40.5 |

As a control, a film unit (Control-III) was prepared and processed in the manner aforedescribed, except that the image-receiving element was comprised of a transparent subcoated polyethylene terephthalate support sheet carrying, in order, an image-receiving layer, coated at a coverage of about 3330 mgs./m.$^2$, and comprising a mixture of (a) one part of a graft copolymer comprising 4-vinylpyridine (4VP) and vinylbenzyl trimethyl ammonium chloride (TMQ) grafted onto hydroxyethyl cellulose (HEC) at a ratio of HEC/4VP/TMQ of 2.2/2.2/1, (b) about 0.13 part of a tetrapolymer of diacetone acrylamide, methacrylic acid, styrene and butyl acrylate at a ratio of 1/1/0.1/0.1 and (c) about 0.017 part of 1,4-butanediol diglycidyl ether cross-linking agent; and a decolorizing layer, coated at a coverage of about 1076 mgs./m.$^2$, and comprising (a) one part of a tetrapolymer of diacetone acrylamide, methacrylic acid, styrene and butyl acrylate at a ratio of 1/1/0.1/0.1, (b) one part of Igepal CO-890 nonylphenoxyethylene oxide ethanol and (c) about 0.35 parts of poly(vinyl pyrrolidone).

The following Dmin results were (reported in Table III) obtained by measuring reflection density initially after 30 days storage at room temperature.

TABLE III

| | Dmin | | | | | |
|---|---|---|---|---|---|---|
| | Initial | | | 30 Days | | |
| Film Unit | R | G | B | R | G | B |
| EXAMPLE 3 | 0.18 | 0.17 | 0.18 | 0.19 | 0.19 | 0.23 |
| Control III | 0.18 | 0.17 | 0.18 | 0.18 | 0.20 | 0.26 |

EXAMPLE 4

A photographic film unit was prepared and processed in the manner described in EXAMPLE 1. The image-receiving element was an element comprised of a transparent subcoated polyethylene terephthalate support coated with an image-receiving layer comprising about 2583 mgs./m.$^2$ of gelatin, about 1722 mgs./m.$^2$ of a 3/1 copolymer of 4-vinylpyridine and vinylbenzyl trimethyl ammonium chloride, about 1292 mgs./m.$^2$ of N-hydroxyethyl-N,N',N'-triscarboxymethyl ethylene diamine and about 72 mgs./m.$^2$ of 1,4-butanediol diglycidyl ether.

As a negative element, there was utilized a negative comprising an opaque subcoated polyethylene terephthalate film base on which the following layers were coated in succession:

1. as a polymeric acid layer approximately nine parts of a half butyl esteer of polyethylene/maleic anhydride copolymer and one part of polyvinyl butyral coated at a coverage of about 26,460 mgs./m.$^2$;
2. a timing layer comprising a mixture of about 3500 mgs./m.$^2$ of a 60/29/6/4/0.4 pentapolymer of butylacrylate, diacetone acrylamide, methacrylic acid, styrene and acrylic acid and about 211 mgs./m.$^2$ of gelatin;

3. a cyan dye developer layer comprising about 600 mgs./m.$^2$ of a cyan dye developer represented by the formula

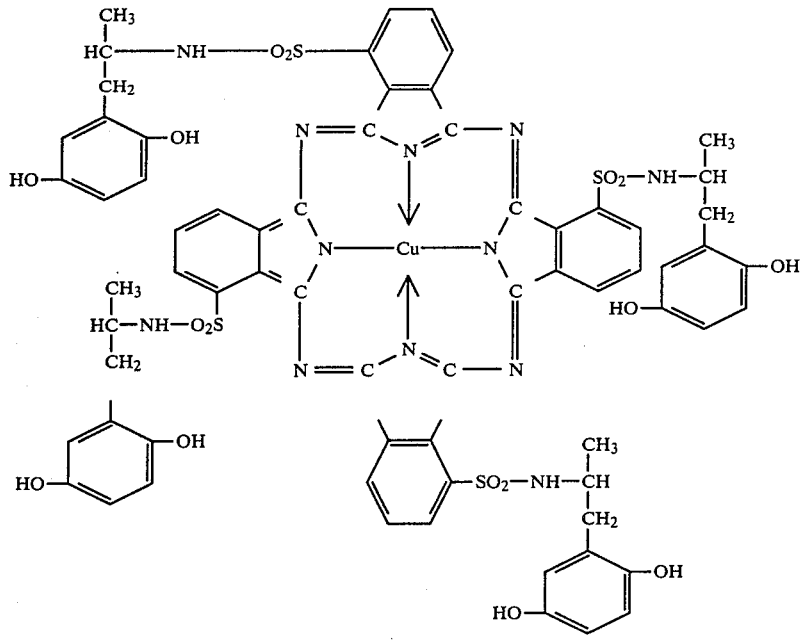

about 121 mgs./m.$^2$ of 4'-methylphenylhydroquinone and about 300 mgs./m.$^2$ of gelatin;

4. a layer comprising a mixture of about 950 mgs./m.$^2$ of titania, about 357 mgs./m.$^2$ of polymethylmethacrylate latex having an average particle size of about 0.11, about 357 mgs./m.$^2$ of the pentapolymer described in layer 2 and about 119 mgs./m.$^2$ of gelatin;
5. a red-sensitive silver iodobromide emulsion layer comprising about 1300 mgs./m.$^2$ of silver and about 780 mgs./m.$^2$ of gelatin;
6. an interlayer comprising about 3000 mgs./m.$^2$ of the pentapolymer described in layer 2, about 30 mgs./m.$^2$ of polyacrylamide and about 30 mgs./m.$^2$ of succindialdehyde;
7. a magenta dye developer layer comprising about 600 mgs./m.$^2$ of a magenta dye developer represented by the formula

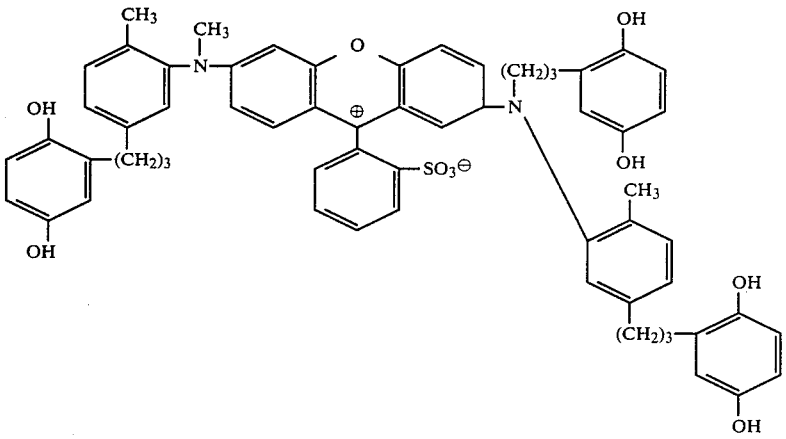

and about 300 mgs./m.$^2$ of gelatin;

8. a green-sensitive silver iodobromide emulsion layer comprising about 1451 mgs./m.$^2$ of silver and about 681 mgs./m.$^2$ of gelatin;
9. an interlayer comprising about 2500 mgs./m.$^2$ of the pentapolymer described in layer 2, about 25 mgs./m.$^2$ of polyacrylamide, about 30 mgs./m.$^2$ of succindialdehyde and about 4 mgs./m.$^2$ of formaldehyde;
10. a layer comprising about 100 mgs./m.$^2$ of gelatin and about 150 mgs./m.$^2$ of phenylbenzimidazole;
11. a yellow dye developer layer comprising about 800 mgs./m.$^2$ of a yellow dye developer represented by the formula

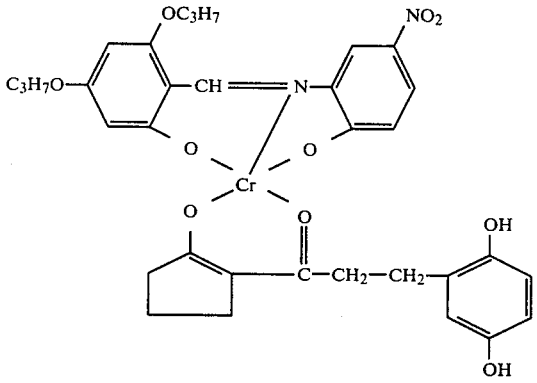

and about 320 mgs./m.$^2$ of gelatin;

12. a blue-sensitive silver iodobromide emulsion layer comprising about 1000 mgs./m.$^2$ of silver, about 616 mgs./m.$^2$ of gelatin and about 263 mgs./m.$^2$ of 4'-methyl phenyl hydroquinone; and 13. a topcoat layer of about 484 mgs./m.$^2$ of gelatin.

A film unit was assembled and processed according to the procedure described in EXAMPLE 1, except that the processing composition utilized was an alkaline processing composition comprising the following components in the stated amounts.

| Components | Parts By Weight |
|---|---|
| Titanium dioxide | 48.1 |
| Potassium hydroxide | 4.67 |
| Poly(diacetone acrylamide)oxime | 0.67 |
| Benzotriazole | 0.46 |
| 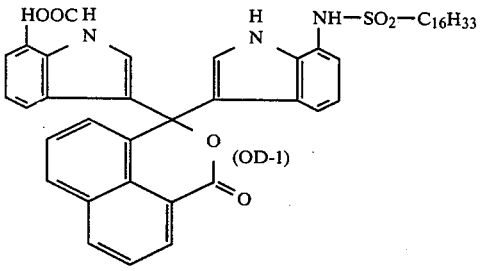 (OD-1) | 0.44 |
| 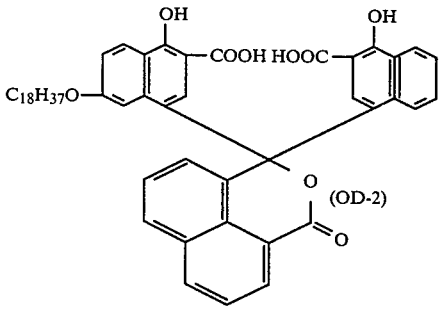 (OD-2) | 1.60 |
| Citric acid | 0.31 |
| N—hydroxyethyl-N,N',N'—triscarboxymethyl ethylene diamine | 0.62 |
| 6-bromo-5-methyl-4-azabenzimidazole | 0.10 |
| Colloidal silica (30% solids) | 0.54 |
| Polyethylene glycol (M.W., approx. 4000) | 0.37 |
| N—phenethyl-α-picolinium bromide | 1.27 |
| N—phenethyl-pyridinium bromide | 0.21 |
| 1-(4-hydroxyphenyl)-tetrazoline-5-thione | 0.04 |
| 1-methylimidazole | 0.69 |

-continued

| Components | Parts By Weight |
|---|---|
| 6-hydroxy-4-amino-pyrazolo-(3,4d)pyrimidine | 0.25 |
| Nickel acetate | 0.41 |
| Water | 38.6 |

The multicolor reflection print obtained in the manner aforedescribed was evaluated by measuring minimum reflection densities in the red, green and blue colums. Measurements were taken initially and after storage under ambient room-temperature conditions for 30 days. The results are reported as follows in TABLE IV.

TABLE IV

| | Dmin | | | | | |
|---|---|---|---|---|---|---|
| | Initial | | | 30 Days | | |
| Film Unit | R | G | B | R | G | B |
| EXAMPLE 4 | 0.18 | 0.16 | 0.15 | 0.20 | 0.18 | 0.20 |

What is claimed is:

1. An integral negative-positive diffusion transfer film unit which comprises in superposed fixed relationship before and after photoexposure:

a photosensitive element comprising an opaque support carrying a plurality of layers including at least one photosensitive silver halide layer having associated therewith a diffusion transfer process image dye-providing material;

an image-receiving element including a transparent support and a unitary image-receiving and decolorizing layer comprising a mixture of gelatin, succinic acid, and a copolymeric mordant comprising recurring units according to the formula

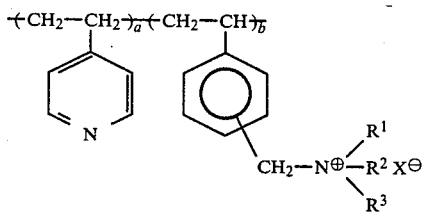

wherein each of $R^1$, $R^2$ and $R^3$ is alkyl, $X^{\ominus}$ is halogen and the molar ratio of the respective recurring units represented by integers a and b is in the range of from about 0.3:1 to about 5:1, the ratio of said copolymeric mordant to said gelatin being in the range of from about 0.6:1 to about 1:1 by weight, and the ratio of said succinic acid to said copolymeric mordant being in the range of about 0.4:1 to about 0.8:1 by weight; and a rupturable container releasably holding an aqueous alkaline processing composition including a pH-sensitive phthalein dye and a light-reflecting pigment, said rupturable container being positioned transverse the leading edge of said film unit so as to release said processing composition for distribution between said elements after photoexposure to provide a light-reflecting layer against which a dye image formed in said unitary image-receiving and decolorizing layer may be viewed through said transparent support without separation of said superposed photosensitive and image-receiving elements.

2. The film unit of claim 1 wherein said copolymeric mordant comprises recurring units according to the formula

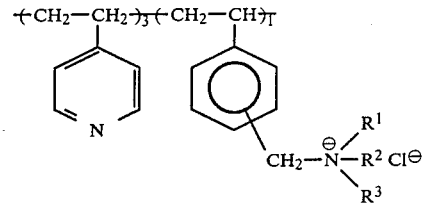

wherein each of $R^1$, $R^2$ and $R^3$ is methyl.

3. The film unit of claim 1 wherein said unitary image-receiving and decolorizing layer additionally includes an amount of up to about 4% by weight by 1,4-butanediol diglycidyl ether.

* * * * *